United States Patent [19]

Bourdon

[11] Patent Number: 4,669,797

[45] Date of Patent: Jun. 2, 1987

[54] ELECTRICAL CONNECTOR ASSEMBLY HAVING A LOCKING ARRANGEMENT

[75] Inventor: Normand C. Bourdon, Unadilla, N.Y.

[73] Assignee: Allied Corporation, Morristown, N.J.

[21] Appl. No.: 848,092

[22] Filed: Apr. 6, 1986

[51] Int. Cl.[4] ..... H01R 13/629

[52] U.S. Cl. ..... 439/353; 439/160

[58] Field of Search ..... 339/91 R, 45 R, 45 M, 339/75 R, 75 M

[56] References Cited

U.S. PATENT DOCUMENTS

| | | | |
|---|---|---|---|
| 3,278,714 | 10/1966 | Bernutz | 339/91 R |
| 3,394,337 | 7/1968 | Miller | 339/91 R |
| 4,113,179 | 9/1978 | McKee | 339/75 M |
| 4,458,972 | 7/1984 | Malmberg et al. | 339/91 R |

FOREIGN PATENT DOCUMENTS

| | | | |
|---|---|---|---|
| 2538396 | 3/1976 | Fed. Rep. of Germany | 339/91 R |
| 2544025 | 4/1977 | Fed. Rep. of Germany | 339/91 R |
| 1517574 | 3/1968 | France | 339/91 R |

*Primary Examiner*—John McQuade

*Attorney, Agent, or Firm*—C. D. Lacina

[57] ABSTRACT

A locking arrangement for mating electrical connector housings includes a locking clip interfitting within a release clip each being releasably inserted into a passage of one housing with a forward end portion of the locking clip extending into a passage of the other housing for locking the mated housings together. Release occurs as a result of manual actuation either by the forward end portions being deflected laterally or by the release clip being pushed axially in its passage towards the forward end portions thereby engaging a protuberance which deflects the end portions laterally and from engagement.

10 Claims, 6 Drawing Figures

FIG. 3
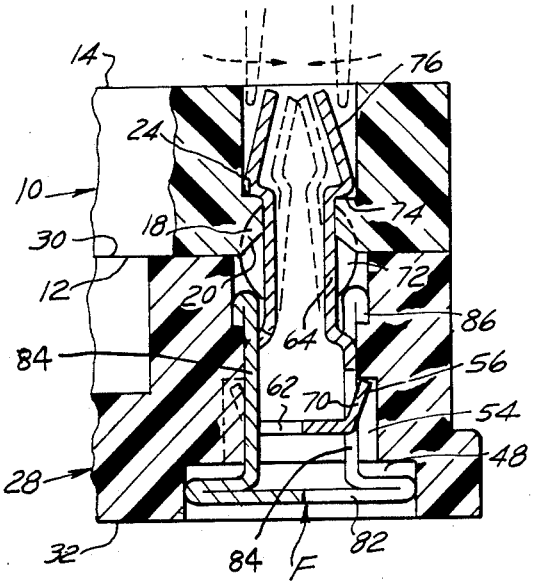
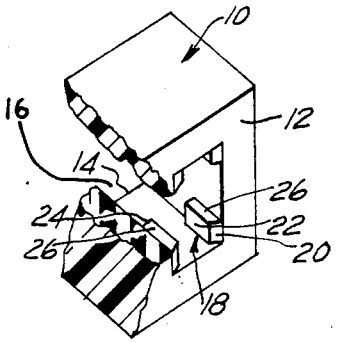
FIG. 2
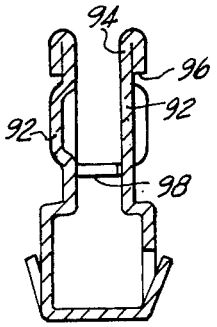
FIG. 4

FIG. 6
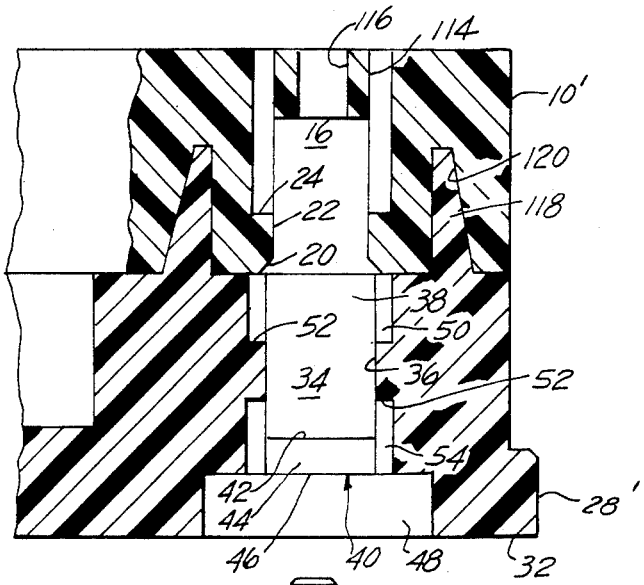
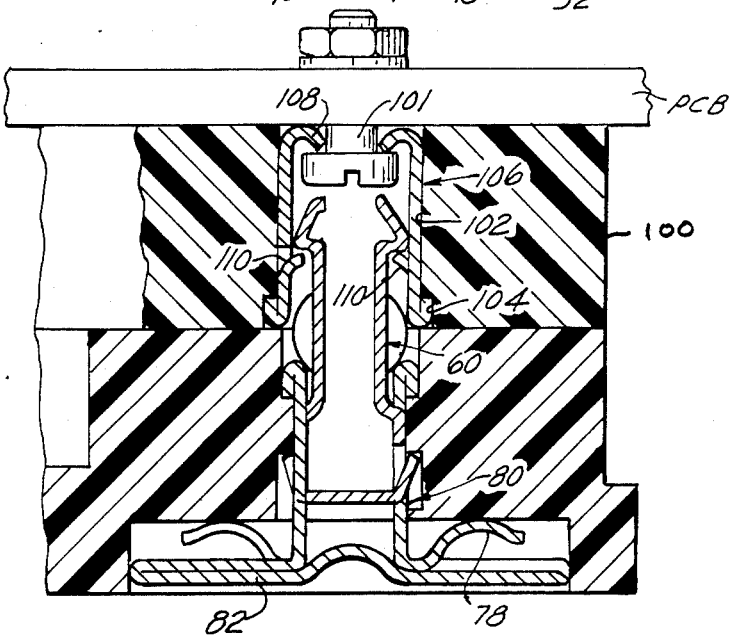
FIG. 5

ELECTRICAL CONNECTOR ASSEMBLY HAVING A LOCKING ARRANGEMENT

This invention relates to locking arrangement for an electrical connector assembly wherein two connector parts mate.

For many years manufactures have supplied users of electrical connectors with locking devices to secure connector assemblies together in an electrical mated relationship. A locking mechanism most commonly used is a threaded stud secured in one connector by means of a locking ring or a shoulder threaded bolt secured with a threaded nut. In the mating connector it is necessary to provide a means for receiving this threaded bolt with either a threaded nut or member which is retained with a locking ring or shouldered member and locking nut. After the two connector assemblies have been mated it is necessary to turn the threaded bolt with a suitable tool to lock the connector assembly together. One disadvantage with this method is the need for a suitable tool to complete locking operation. Also, this method is time consuming and of course in the case where the connector assembly has two locks an operator can only perform the locking or unlocking on one lock at a time.

Another method of securing two connector assemblies together is with a key shaped member which has a shaft and a projection which when mated with its respective member is turned and the projection locks behind a shoulder or undercut of the respective mating connector. This method has the same disadvantages as first method mentioned plus the disadvantage of being a less positive lock without a more costly construction to insure locking action.

A more desirable locking arrangement would be one which provides the user with a quick locking and releasing action that is self-contained, which may be used without requiring a separate tool and provides a positive lock.

The locking arrangement herein releasably locks a pair of matable connector housings together when respective top mating faces are abutted and axial passages are aligned and is characterized by a locking clip and a manually actuatable release clip each being mounted in the axial passage of one connector housing, the locking clip extending into the axial passage of the other connector housing for releasable engagement therewith, manual action of the release clip in a first direction causing the engaging portions to move in a second direction to disengage. The engaged portions may also be manually disengaged without the release clip. The release clip is provided with a release button with integral spring members to assure that the release clip always returns to its unactuated position.

A further connector assembly herein provides a locking arrangement which includes a mounting mechanism for attaching the connector assembly to a panel or printed circuit board.

Advantages of the locking arrangement is provision of a quick and uncomplicated method of retaining mated connectors together. The arrangement also provides within the same mechanism a release mechanism which when pushed drives a lock beam from a locked position to a releasing position whereby the connector housings can be pulled apart. One way of carrying out the invention is described below with reference to the drawings in which:

FIG. 2 is a partial view in section of one connector part taken along linens II—II of FIG. 1.

FIG. 3 is a cross-section on view of the connector assembly taken along lines III—III of FIG. 1 when the connector parts are mated and locked.

FIG. 4 is a spring lock for use in the connector assembly shown in FIG. 1.

FIG. 5 is a partial cross-sectional view of a mated connector assembly having a releasable lock clip and a self-returning release clip in one connector part and a mounting clip in the other connector part.

FIG. 6 illustrates a connector assembly including means incorporated in the connector parts for protecting the engaging portions of the lock clip when not in use.

Figure 1:
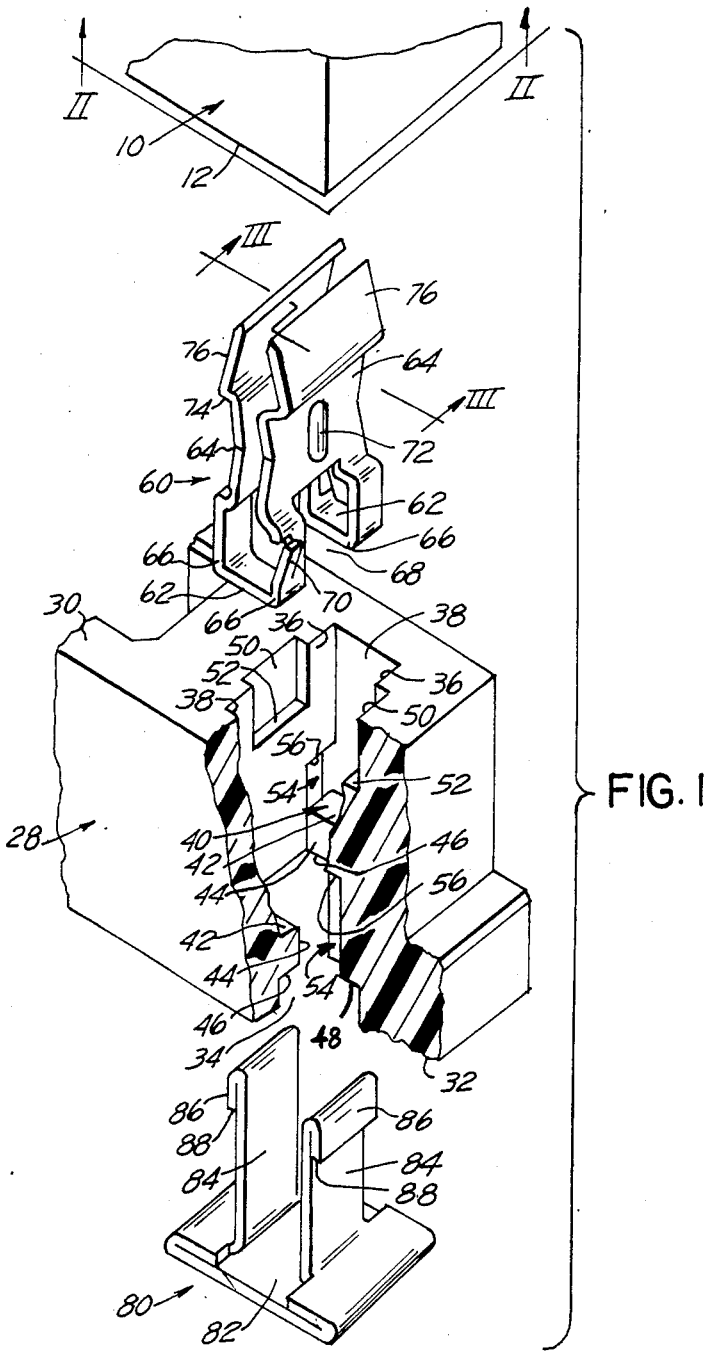
FIG. 1 is an exploded partial cross-sectional view of a two-part connector assembly positioned for mating and incorporating a releasable locking arrangement.

Referring now to the drawings, FIG. 1 shows a partial exploded view in section of a pair of matable connector parts, a locking clip 60, and a release clip 80. The connector parts could be plug and receptacle electrical connector housing 10, 28 each constructed of a moldable dielectric material and carrying terminal elements (not shown) which mate with one another when the housing members are mated.

Each connector housing 10,28 is generally rectangular and includes respectively, a forward or mating top face 12, 30, a rearward or bottom face 14, 32, and a rectangular shaped axial passage 16, 34 extending between the faces. When the connector housings are mated, the mating top faces 12, 30 abut and the passages 16, 34 are axially aligned.

Passage 34 of the connector housing 28 includes undercuts, recesses, and cavities in opposite passage walls 36, 38 thereof whereby to captivate the locking clip and the release clip. A projection 40 extends from each wall 36 and towards one another to define both a rearward stop for locking clip 60 when inserted into the passage through the top mating face and a recess 48 for the release clip 80 when inserted into the passage through the bottom face, each projection being formed by surfaces 42, 44 and 46. Surfaces 42 face forwardly to define the stop to limit inward insertion of a base 62 of the locking clip. Surfaces 44 face one another and form a guide through which actuator beams of the release clip must pass. Surfaces 46 face rearwardly to define the recess 48 and a stop to limit inward insertion of an actuator plate of the release clip. Undercuts 50 extend into passage walls 36 each facing one another and extending downwardly from the top mating face 30 to define a forwardly facing endwall 52. Cavities 54 extend into passage walls 36 each being axisymmetrically disposed adjacent one respective surface 42 and including a rearwardly facing endwall 56. While shown best in FIG. 6, each cavity 54 communicates with the recess 48.

The locking clip 60 and the release clip 80 are releasably received in the passage 34 of connector housing 28. Locking clip 60 is generally U-shaped and stamped and formed from resilient material and includes the base 62 adapted to seat on the forwardly facing shoulder 42, and a pair of lock beams 64 each extending upwardly from the base and terminating in a forward end portion 76. The forward end portions are laterally deflectable and adapted to be received in the passage 16 of the housing member 10 to releasably lock the housings. Two spaced pairs of webs 66 form a transition between the base and the deflectable lock beams 64 each pair defining an opening 68 through which the release clip may interfit. Lock beams 64 are elongated, medially recessed towards one another, and include a medial protuberance 72 which is acted upon by the release clip. The forward end portions 76 are reversely bent relative to their associated lock beam so as to form an abutment 74 for engaging the passage 16.

Locking clip 60 is retained in connector housing 28 by means of a pair of integrally formed deflectable spring retention lances 70 each extending from axisymmetric webs, the lances being entrapped in the cavities 54 and abutting the endwalls 56. To effectuate release of the locking clip a tool (such as a screwdriver) is inserted upwardly from the bottom face and into the cavity 54 whereby to deflect the lance 70 from engagement with the endwall 56 thereof.

Release clip 80 is stamped and formed from resilient material into a U-shape and includes an actuator plate 82, and a pair of actuator beams 84 each extending upwardly from the actuator plate and terminating in an enlarged projection 86 which defines an abutment 88 for seating against the endwall 52 of an undercut 50 whereby to retain the release clip.

FIG. 2 illustrates a partial view in section of electrical connector housing 10 and includes the forward or top mating face 12, the rearward or bottom face 14, and the passage 16 extending between the faces. Integral to the passage wall are four ramp members 18 each formed by surfaces 20, 22, 24, 26. Forward surfaces 20 angle inwardly and rearwardly from top mating face 12 to form a guiding entry for receiving and deflecting the forward end portions of locking clip 60. Rearward surfaces 24 form a shoulder to entrap locking abutments 74 of the locking beams 64. In the configuration shown side surfaces 26 of adjacent ramps 18 form a throat for the respective protuberances 72. Top surfaces 22 form a transition between the forward and rearward surfaces of the ramp.

FIG. 3 shows a mated electrical connector assembly and the locked relation of the locking beams 64 and the actuator beams 84 interfitted therewith whereby to be slidably urged axially forward and against the medial protuberances 72 to effect release of the abutments 74 from locked engagement with rearward surfaces 24.

It is preferably to assemble release clip 80 into passage 34 of connector housing 28 prior to inserting locking clip 60. Upon inserting release clip 80 into passage 34 from the bottom face 32, actuator beams 84 deflect inwardly until abutments 88 seat on the endwalls 52 of the undercut 50. Locking clip 60 is inserted into passage 34 from the mating top face 30 until base 62 seats on surfaces 42 whereupon the lances captivate the locking clip 60. The lances 70 deflect inwardly to allow the locking clip 60 to pass through walls 36 and snap outwardly to seat in its cavity 54 when the base is seated against surface 42.

By applying inward axial force against actuator plate 82 of release clip 80, actuator beams 84 are driven towards the forward end portions 76 and engage the protuberances 72 and deflect the lock beams 64 towards one another whereby the abutments 74 are removed from engagement with rearward surfaces 24 in the the other passage 16. It will be observed the manual actuation of the forward end portions will also allow release, such manual manipulation possibly being effected by a release tool inserted into the other passage from the bottom face 14 of connector housing 10.

FIG. 4 illustrates a U-shaped locking clip including locking beams 92 each including a forward end portion 94 and an abutment 96. A stub 98 extends laterally between the locking beams to prevent the locking beams from being adversely deformed (e.g., locally buckled) and to maintain the U-shape of the locking clip whereby the forward end portions will not easily be deflected inwardly.

FIG. 5 illustrates a connector housing 100 with an axial passage 102 having a counterbore 104 receiving a lock mounting clip 106, the mounting clip being fabricated with a hole 108 for receiving a screw 101 for securing the connector housing to a printed circuit board (PCB). Mounting clip 106 has rigidly formed lances 110 which form landings for locking against abutments 74 of lock clip 60. Integral to release clip 80 are spring beams 78 which return release clip 80 to the same position after each sliding actuation. the locking and unlocking action is identical to that shown in FIG. 1.

FIG. 6 illustrates mating and unmating connector housings 10',28' adapted for use with lock clip 60 and release clip 80 described in FIGS. 1–3. Further locking in connector housing 10' is by means of an integral support sleeve 114 having a central bore 116 for receiving a retaining screw 101. By using this configuration the lock mounting clip 106 in FIG. 5 is eliminated.

Also shown in projection 118 and recess 120 which protect the exposed forward end portions of the lock beams of lock clip 60 against damage during field use and also provide a guide for mating the connector housings. Projection 118 and its associated recess could form a continuous 360° annulus.

Other embodiments of the invention are easily realized by slight changes in the design described. The rectangular opening of FIG. 2 formed by side surfaces 26 and passage 16 could be eliminated if protuberances 72 of lock clip 60 was located rearwardly of mating top face 30 of connector housing 28. This also would allow the full length of locking abutments 74 to rest against a full rearward surfaces 24, thus obtaining a stronger lock. Like locking arrangements could be positioned at more than one location on the connector housings.

Having thus described the invention what is claimed is:

1. In an electrical connector assembly comprising matable first and second housing members each including, respectively, a top face, a bottom face, an axial passage extending between the faces, and a terminal element for electrical interconnection, the terminal elements mating with one another when said housing members are mated, locking means for releasably locking said housing members together when they are mated, and release means for releasing the locking means, the improvement wherein said locking means comprises a locking clip of resilient material insertable through the top face of the first housing member to detachably mount in the passage thereof, and said release means being movably disposed in the passage of and accessible through the bottom face of the first housing member, said clip including a base lockable against axial movement relative to its passage, and an elongated lock beam extending from said base and terminating at a forward end portion adapted to releasably lock within the passage of said second housing member, said forward end portion being accessible for releasing manipulation through the bottom face of said second housing member or through the bottom face of said first housing member by said release means causing the forward end portion to deflect laterally of the base.

2. The electrical connector assembly as recited in claim 1 wherein said lock beam includes a ramp extending therefrom, and said release means comprises a manually actuatable actuator member including an actuator plate, and an elongated actuator beam extending perpendicularly from said actuator plate and adapted to engage said ramp, said actuator beam being slidably disposed in the passage of said first housing member for axial movement therewithin from a locking first position wherein said forward end portion is engaging the other passage and to a releasing second postion to engage the ramp whereby to deflect the lock beam laterally of its base and from locked engagement with the other passage.

3. The electrical connector assembly as recited in claim 2 wherein said lock clip is integrally stamped and formed into a U-shape from a resilient metal to define a pair of lock beams and a pair of webs, each web joining one lock beam to the base and each web including an opening, each lock beam extending generally perpendicularly from the base and including a transverse protuberance medially of its length, said actuator member has its actuator plate disposed in the passage of said first housing member adjacent to the bottom face thereof and includes a pair of actuator beams each said actuator beam being attached to said actuator plate and each terminating in an enlarged portion, said actuator beams being interfitted into the opening of one respective lock beam for slidable axial movement therewithin and movable from the locking first position to the releasing second position, and said enlarged portions being adapted to engage the protuberance on its respective lock beam when moved to the second position whereby to laterally deflect the forward end portion of the lock beam associated therewith, each said actuator beam extending in the same direction as each said lock beam.

4. The electrical connector assembly as recited in claim 1 wherein said locking clip comprises a U-shaped frame comprising the base and two said lock beams each extending generally perpendicularly from said base, and further including releasable retention means adjacent to said base for retaining the clip in the passage of said first housing member.

5. The electrical connector assembly as recited in claim 4 wherein a ramp projects from each said lock beam, a web extends from each corner of said base to form along opposite sides thereof a first and a second pair of webs each pair defining a transition between the base and one said lock beam, and said release means comprises a U-shaped actuator member including an actuator plate, and a pair of elongated actuator beams each extending perpendicularly from said actuator plate and terminating in an enlarged free end adapted to engage one respective ramp, said actuator member being insertable into said one passage from the bottom face of the first housing member and said actuator beams being insertable, respectively, between one said first and second pair of webs, external axial force on the actuator plate causing the free ends of said actuator beams to move axially in said one passage from a locking first position wherein said forward end portions are lockingly engaged with the other passage and to a second releasing position to simultaneously engage the ramps whereby to deflect the lock beams laterally relative to their securement to the base and from locked engagement with the other passage.

6. The electrical connector assembly as recited in claim 5 wherein said retention means comprises a resilient retention lance extending from said locking clip, and further including guide means associated with the passage in said first housing member and adjacent to the top face thereof for guiding the locking clip during its insertion therein, the passage in said first housing member being generally rectangular in cross-section and including a pair of shoulders one shoulder facing towards the top face and forming an abutment for the base to seat on the other shoulder facing towards the bottom face and forming an abutment for engagement by the retention lance.

7. In an electrical connector assembly comprising releasable matable first and second housing members which are respectively provided with terminal elements which mate with one another when said housing members are mated, releasable locking means for releasably locking said housing members when they are mated, said locking means characterized by a pair of axial passages one and the other being disposed, respectively, in said first and second housing member and each being axially aligned upon mating of the housing members, a locking clip of resilient material having a base portion disposed in one passage and a forward end portion adapted to be received in the other passage, said base portion being releasably fixed to said one passage and said forward end portion having a free end adapted to releasably lock within said other passage, retention means including a pair of shoulders for releasably positioning said clip in said one passage and latching the forward end portion in said other passage, and actuation means movable in a first direction and operable to move the forward end portion in a second direction for actuating release of the locking clip.

8. An insertable latch arrangement for releasably latching matable first and second housing members each respectively being provided with an axial passage and a terminal with the passages axially aligned and the terminals mating with one another when the housing members are mated, the latching arrangement being mountable in the passage of said first housing member and characterized by a latch member for latching the housing members together, an axially slidable actuator member, and a ramp operative against said latch member upon sliding of said actuator member for releasing the latch member from latched relation, said latch member comprising a base portion to fixedly mount the latch member in the passage of said first housing member, and an elongated, laterally deflectable, latch arm extending axially from said base portion for latching within the passage of said second housing member, said actuator member being constrained to slide within the passage of said first housing member from a locking first position to a releasing second position, and said ramp extending from said latch arm and adapted to be engaged by the actuator member, the actuator member sliding to the second position driving against the ramp whereby the latch arm is laterally deflected.

9. The insertable latch arrangement as recited in claim 8 wherein said latch member and actuator member are generally U-shaped, said latch member comprising a pair of latch arms each extending upwardly from the base portion and including an opening, the actuator member interfitting within the latch member and through the respective openings of the latch arms, and a pair of second ramps each second ramp being operative between said passage in the second housing member and one respective latch arm for laterally deflecting the latch arms as a result of the latch arms being received by and the second ramps being forced against the passage in the second housing member.

10. An electrical connector assembly including two generally rectangular connector parts each having an axial passage extending between its bottom and top mating faces and separately held together in mated relation by a releasable lock arrangement comprising a pair of elongated laterally deflectable lock beams, and an axially movable release member, each said lock beam having, respectively, a rearward end portion fixedly disposed in one passage, a medial protuberance extending transversely therefrom, and a forward end portion adapted to extend into the other passage when the passages are aligned and the mating faces are abutted, said forward end portions being adapted to engage the other passage whereby to lock the connector parts together and each being adapted to be deflected in a direction transversely of its length, said release member being accessible adjacent the bottom face of said one passage and movable in an axial direction towards the forward end portions for simultaneous engagement with the protuberances whereby to deflect said forward end portions transversely and from engagement with the other passage.

* * * * *